United States Patent [19]

Martin et al.

[11] Patent Number: 5,073,105

[45] Date of Patent: Dec. 17, 1991

[54] LOW $NO_x$ BURNER ASSEMBLIES

[75] Inventors: Richard R. Martin, Tulsa; G. Richard Ogden, Bristow; Paul M. Rodden, Sand Springs, all of Okla.

[73] Assignee: Callidus Technologies Inc., Tulsa, Okla.

[21] Appl. No.: 694,082

[22] Filed: May 1, 1991

[51] Int. Cl.[5] ..... F23L 7/00

[52] U.S. Cl. ..... 431/116

[58] Field of Search ..... 431/116, 115

[56] References Cited

U.S. PATENT DOCUMENTS

| | | | |
|---|---|---|---|
| 2,174,663 | 10/1939 | Keller | 431/115 |
| 2,918,117 | 12/1959 | Griffin | 431/116 |
| 4,277,942 | 7/1981 | Egnell et al. | 431/116 |
| 4,483,832 | 11/1984 | Schirmer | 431/116 |

*Primary Examiner*—Carroll B. Dority

*Attorney, Agent, or Firm*—Breiner & Breiner

[57] ABSTRACT

A burner assembly for process heaters or the like comprising a burner block, primary gas jets, secondary gas jets, a flame holder, and an air register for installation in a furnace wall or furnace floor is described. The burners are characterized in that primary fuel is introduced into the primary combustion zone of the burner at an angle horizontal to the flame holder whereby the fuel induces furnace gases from the furnace into the primary combustion zone. Similarly, the secondary fuel jets introduce a secondary fuel through the burner block for consumption in a combustion zone at the surface of the burner block. The secondary fuel also draws furnace gases into the combustion zone for consumption. The design provides for intense mixing of combustion air with the fuel and furnace gases, resulting in low $NO_x$ levels.

7 Claims, 2 Drawing Sheets

LOW $NO_x$ BURNER ASSEMBLIES

FIELD OF THE INVENTION

The present invention relates to burner designs. More particularly, the invention relates to an improved natural draft or forced draft burner which provides a means for introducing or drawing furnace gases into the combustion zone or zones of the burner to reduce the $NO_x$ level of the exhaust gases.

BACKGROUND OF THE INVENTION $NO_x$ gases are recognized to be a major source of air pollution in the United States and in all industrialized countries of the world. As a result, environmental emission standards are being imposed by various governmental authorities which limit the amount of $NO_x$ gases which can be emitted into the atmosphere. These standards have led to the development of various burners designed to inhibit the production of $NO_x$ gases or to consume furnace gases containing $NO_x$ gases. Such designs include burners which inject a jet of combustible gas or liquid axially into a flame through a center passage, and furnace gases or flue gases mixed with air are introduced through surrounding passages. Other designs include means for the introduction of a primary fuel axially into a burner combustion zone and steam radially into a burner combustion zone which, in turn, draws furnace gases into the burner combustion zone for consumption. Although various of these designs are advantageous, there is a need for burner designs having improved efficiency particularly in the ability of the burners to draw the furnace or flue gases into the combustion zone rapidly and in large quantities for mixing with fuel and combustion air, and consumption without the assistance of steam or other gases.

SUMMARY OF THE INVENTION

The present invention is directed to an improved natural draft burner for process heaters, boilers or the like, or for forced draft burners in process heaters, boilers or the like, comprising as the major components a burner block, a plurality of primary fuel jets or tips, a plurality of secondary fuel jets or tips, a flame holder, and an air register or air windbox for installation in an environment such as a furnace wall or floor. The burners are characterized in that the primary fuel is introduced into the primary combustion zone of the burner from the primary fuel jets at an angle substantially horizontal and radially to tangentially to the flame holder whereby the injected fuel induces furnace gases from the furnace into the primary combustion zone. Combustion air is fed into the primary combustion zone, preferably from below the combustion zone. This design provides an exceptionally high degree of mixing of combustion air with the fuel and furnace gas mixture, providing low flame temperature and good burner stability. The horizontal introduction of the primary fuel into a burner combustion zone, which is unique to the present design, thus leads to a rapid and effective introduction of flue or furnace gases into the primary combustion zone without the assistance of steam.

Most preferably, 100% of the primary fuel will be radially injected into the primary combustion zone of the burner. It is possible, however, to inject a portion of the primary fuel axially into the combustion zone, i.e., up to about 15%, and still have an adequate burner. Heretofore the primary fuel has been injected axially to provide flame stability. These burners have commonly utilized another gas such as steam to assist in the injection of flue gases into the combustion zone. Injection of 100% of the primary fuel radially, according to the present invention, reduces or eliminates the need for the steam assist, thereby reducing the operating cost for the burner.

As a further improved feature of the burner of the present invention, a plurality of secondary fuel jets or tips are utilized to introduce a secondary fuel through the burner block assembly for consumption in a combustion zone at the surface of the burner block. This introduction of a secondary fuel is also highly effective in drawing furnace gases to the combustion zone for combustion. Thus, in a preferred embodiment of the present invention the burner utilizes primary fuel tips only or both primary fuel tips and secondary fuel tips, with the fuel being split between the two tips in proportions of from about 80% primary and 20% secondary, to 20% primary and 80% secondary. Preferably, the split will be in the range of from about 50% primary and 50% secondary, to 30% primary and 70% secondary.

The design of the present invention provides a unique and highly effective low NO burner assembly.

BRIEF DESCRIPTION OF THE DRAWING

Referring to the drawing.

DETAILED DESCRIPTION OF PRESENTLY PREFERRED EMBODIMENT

Figure 1:
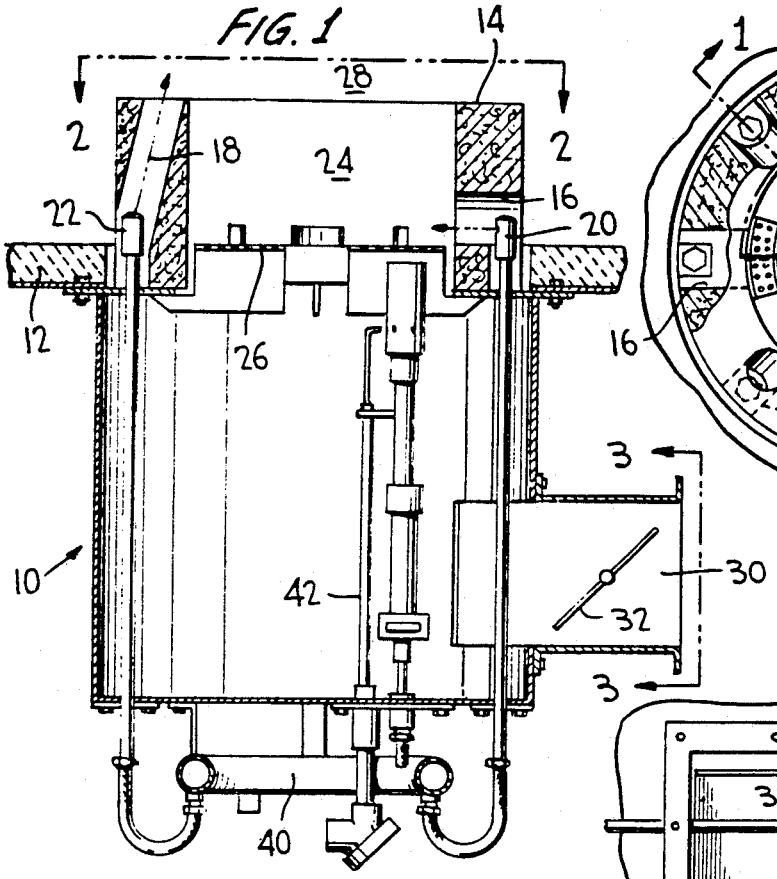
FIG. 1 is a cross-section of a first embodiment of a burner of the present invention taken along line 1—1 of FIG. 2 mounted in an environment of use, such as a furnace floor or wall of a furnace stack.
Figure 2:
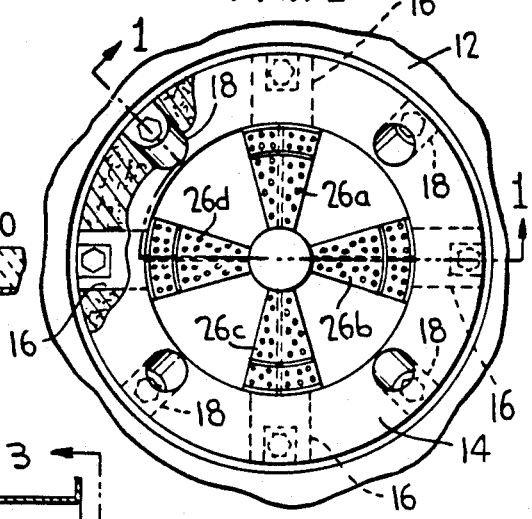
FIG. 2 is a plan view taken along line 2—2 of FIG. 1 of a first embodiment of the flame holder of the burner assembly of the present invention.
Figure 5:
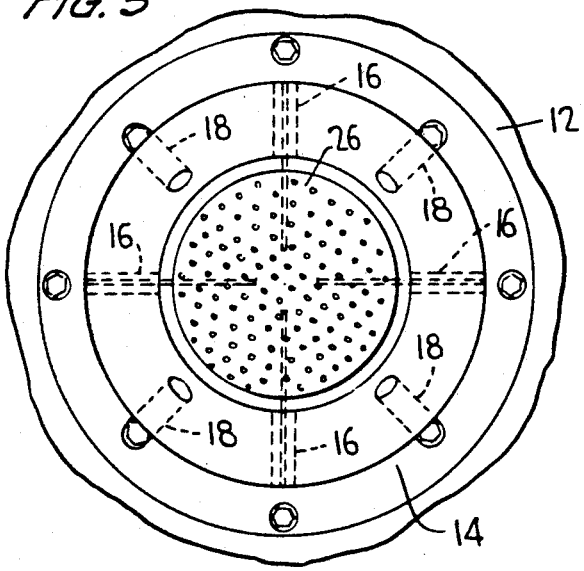
FIG. 5 is a view taken along line 2—2 of FIG. 1 of a modified burner holder.

Referring first to FIGS. 1, 2 and 5 of the drawing, the burner assembly 10 is positioned in a wall or floor 12 of a furnace. The assembly includes a burner block 14 which preferably extends beyond the furnace wall or floor 12 and has openings 16 and 18 for receiving, respectively, primary fuel jets or tips 20 and secondary fuel jets or tips 22. As illustrated, openings 16 are horizontally, or substantially horizontally disposed in block 14, causing the primary fuel to be directed into combustion zone 24 from jet 20 horizontal to and across flame holder 26. Flame holder 26 is preferably a perforated plate, but can have other designs. Openings 18 are disposed in burner block 14 at an angle, causing secondary fuel from jets 22 to emerge at the downstream end of burner block 14 in combustion zone 28 which is merged with combustion zone 24.

The discharge of the primary gas from the primary gas jets 20 creates a low-pressure zone that induces combustion products from the furnace to enter openings 16 of burner block 14 and into the combustion zone 24 for consumption. Similarly, the secondary gas tips induce combustion products from the furnace through openings 18 to emerge at the surface of the burner block 14 in combustion zone 28.

As apparent from FIG. 1, combustion air enters the burner assembly through an airbox 30 and flows up from the bottom of flame holder 26 into combustion zone 24. All of the combustion air flows into the combustion zone. There is no secondary combustion air flow in the burner assembly. The combustion air and primary fuel/furnace gases mix in primary combustion zone 24 where flame is initiated. It is critical to have the uniform mixing of the gases in combustion zone 24 as provided by this invention to achieve the lowest possible $NO_x$ levels. Thus, an important feature of the presently described burner is that the flame holder/mixing element causes the injected fuel and furnace gases to spread out radially over the flame holder and mix with the combustion air.

Figure 3:
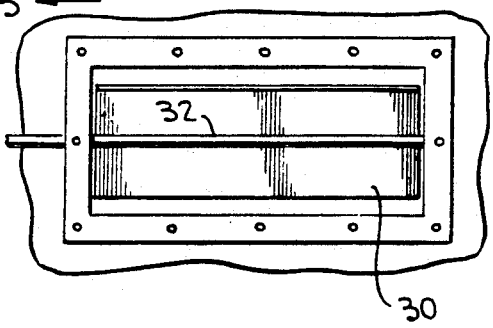
FIG. 3 is a view taken along line 3—3 of FIG. 1 showing airbox means for drawing air into the burner.

As illustrated in FIGS. 1 and 3 of the drawing, the airbox 30 for introduction of combustion air has a baffle means 32 to regulate the amount of air flowing into the burner. If greater air flow is desired, fan means or the like can be included in the airbox.

The primary and secondary fuels are fed to the plurality of primary and the plurality of secondary jets 20 and 18, respectively, from a manifold 40. The furnace also includes an igniter 42 for lighting off the burner assembly.

Figure 4:
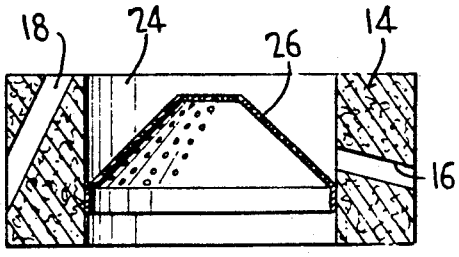
FIG. 4 is a modified embodiment of the flame holder of the burner assembly.

FIG. 2 is a plan view taken along line 2—2 of FIG. 1 and shows a first flame holder design comprising four separate perforated plate elements 26*a*, 26*b*, 26*c* and 26*d*, providing for good burner stability. A second design of the flame holder is shown in FIG. 5 wherein the flame holder is essentially a single perforated plate. Various modifications in the flame holder are possible while still providing good burner stability. Thus, FIG. 4 illustrates another design showing a flame holder in the form of an inverted cone, with the primary gas jets entering the burner block at a slight angle, or tangentially, as opposed to being directly horizontal. Since the flame holder is in the form of a cone, there will still be good mixing of the primary fuel with the combustion air and furnace flue gases.

Figure 6:
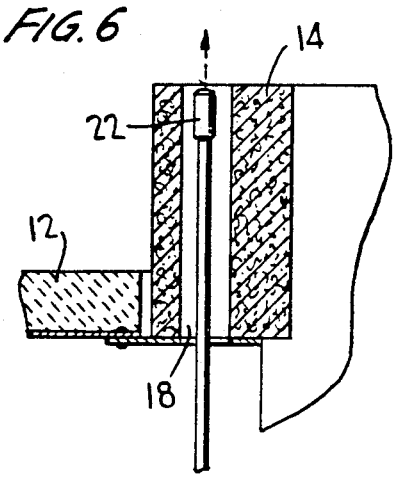
FIG. 6 is a partial cross-section of the burner of FIG. 1 modified to the extent that the secondary fuel is injected at the downstream end of the burner block.

FIG. 6 illustrates a burner block 14 wherein hole 18 is vertical in the block with tip 22 extending all the way to the downstream end of the burner block. Thus, the burner utilizes tips 20 and passage 16 as in FIG. 1, but with staged fuel injected by using a conventional staged fuel tip which extends to the downstream end of the block.

Figure 7:
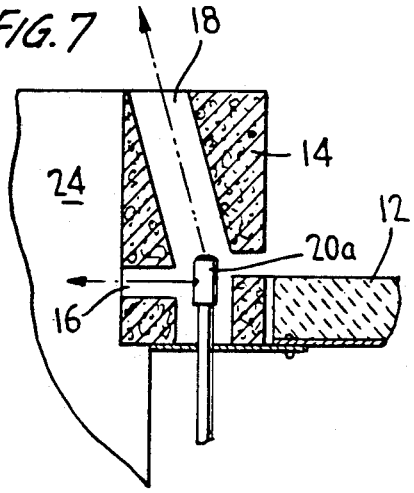
FIG. 7 is a partial cross-section of the burner of FIG. 1 modified to the extent that a single injector feeds both the primary gas horizontally into the combustion zone and a secondary gas at an angle at the downstream end of the burner block.

FIG. 7 illustrates the burner block of FIG. 1. However, in this configuration a single fuel tip provides both primary and staged fuel. As shown, tip 20*a* has a port drilled for horizontal injection of the primary fuel into the primary combustion zone 24 with an additional port drilled in its end for injecting a secondary or staged fuel through opening 18 to the downstream end of the burner block.

Figure 8:
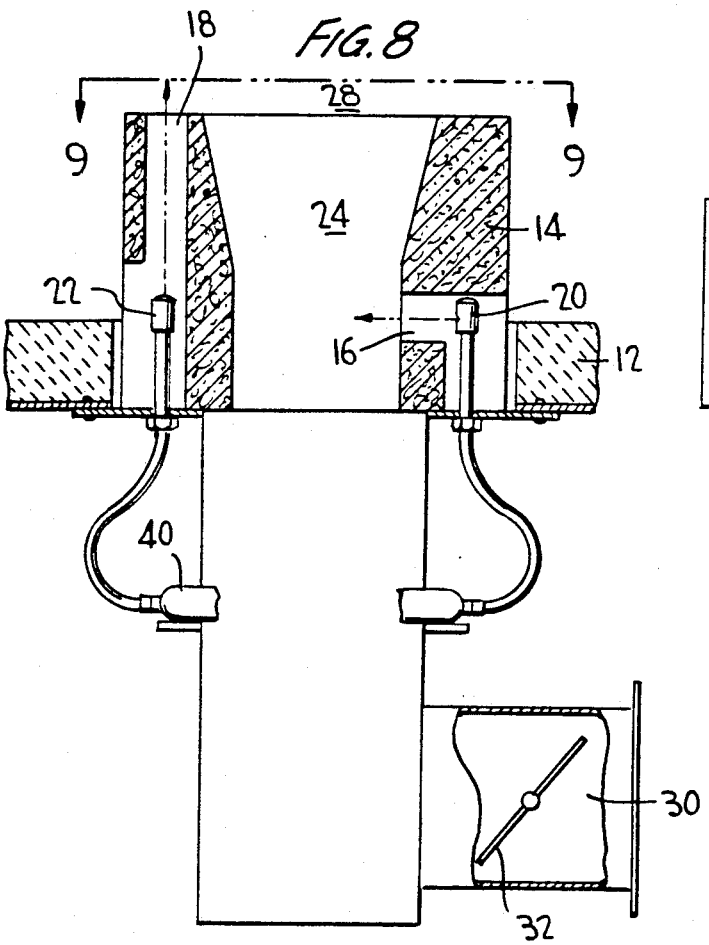
FIG. 8 is a cross-section of a second embodiment of a burner of the present invention taken along line 8—8 of FIG. 9, again mounted in an environment of use.
Figure 9:
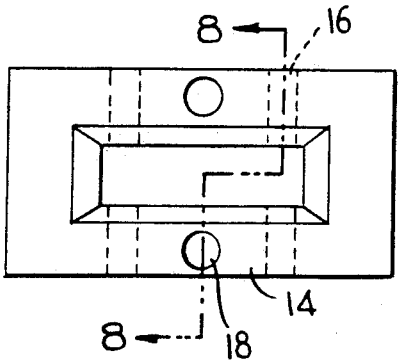
FIG. 9 is a plan view taken along line 9—9 of FIG. 8 of the second embodiment of the burner assembly of the present invention.

FIGS. 8 and 9 illustrate a burner block having a rectangular shape. The burner of FIGS. 8 and 9 is otherwise essentially the same as the burner of FIG. 1. Because of its shape, it will provide a "flat" flame.

As will be apparent to one skilled in the art, various design modifications can be made within the scope of the aforesaid description. For example, the number of primary and secondary jets can vary from one to four or more as desired. Additionally, the fuel introduced into the burner assembly can be a gaseous fuel or liquid fuel as desired. Further, the combustion air can be mixed with oxygen to increase the heat capacity of the burner also if desired. Although it is not essential to use steam with the burner of the present design, it is possible and may be desirable at times to mix steam with the fuel or add steam through a separate burner injector. Such modifications being within the ability of one skilled in the art form a part of the present invention and are embraced by the appended claims.

It is claimed:

1. A burner assembly comprising in combination a burner block, a flame holder within said burner block and positioned below the upper surface of said burner block to form a combustion zone within said burner block, a plurality of holes in said burner block substantially horizontally disposed therein and a primary fuel jet positioned at each of said holes for introducing a primary fuel across the face of said flame holder without substantial axial fuel injection, and means for introducing combustion air into said combustion zone; said horizontally disposed holes being positioned and said primary jets being constructed and arranged to draw gas surrounding said burner assembly into said combustion zone.

2. The burner assembly of claim 1 wherein said burner block further includes a plurality of angularly disposed holes within said burner block, said angularly disposed holes beginning at an angular wall of said block and terminating at an outer surface of said burner block, and a secondary fuel jet positioned at the beginning of each of said holes for introducing a secondary fuel into said holes for exit at said outer surface of said burner block, said angular holes being positioned and said secondary fuel jets being designed to drawn gases surrounding said burner assembly into said combustion zone.

3. The burner assembly of claim 1 or claim 2 wherein said flame holder is a perforated plate.

4. The flame holder of claim 1 or claim 2 wherein the flame holder is an inverted cone.

5. The burner assembly of claim 1 positioned in the environment of a furnace.

6. The burner assembly of claim 1 positioned in the environment of a boiler.

7. The burner assembly of claim 1 positioned in the environment of an exhaust gas stack.

* * * * *